United States Patent [19]

Schnäbele et al.

[11] 4,148,244

[45] Apr. 10, 1979

[54] APPARATUS FOR BRAKING A FREE PISTON, WHICH IS DRIVEN AT HIGH ACCELERATION WITHIN A TUBE

[75] Inventors: Werner Schnäbele, Wolfratshausen; Paul von Malottki, Ottobrunn, both of Fed. Rep. of Germany

[73] Assignee: Messerschmitt-Bölkow-Blohm Gesellschaft mit beschrankter Haftung, Fed. Rep. of Germany

[21] Appl. No.: 848,195

[22] Filed: Nov. 3, 1977

[30] Foreign Application Priority Data

Nov. 10, 1976 [DE] Fed. Rep. of Germany ..... 2651167

[51] Int. Cl.[2] ..... F41F 3/02

[52] U.S. Cl. ..... 89/1.701; 188/1 C

[58] Field of Search ..... 188/1 C; 92/85 R; 74/492; 89/1.701, 1.702, 1.703, 1.7

[56] References Cited

U.S. PATENT DOCUMENTS

| | | | |
|---|---|---|---|
| 3,234,727 | 2/1966 | Filer | 188/1 C X |
| 3,450,233 | 6/1969 | Massa | 188/1 C |
| 3,762,279 | 10/1973 | Zeyher | 188/1 C X |
| 3,771,417 | 11/1973 | Schnabele et al. | 89/1.701 |
| 3,779,130 | 12/1973 | Schnabele | 89/1.701 |
| 3,779,591 | 12/1973 | Rands | 188/1 C X |
| 3,915,486 | 10/1975 | Maeda et al. | 188/1 C X |

*Primary Examiner*—David H. Brown
*Attorney, Agent, or Firm*—McGlew and Tuttle

[57] ABSTRACT

An apparatus for braking a free piston which is driven at a high acceleration within a tube and, particularly, in a recoilless firearm, comprises a tube which has a first portion of a first diameter and a second portion of a second diameter greater than the first portion with a transition portion therebetween. A free piston is freely movable in the first portion and it has substantially the same diameter as the first portion. A braking sleeve is secured to the interior wall of the tube in the second portion thereof and it has an edge facing the piston which is beveled inwardly to a knife edge. A deformation ring is carried in the second portion between the braking sleeve and the piston and the piston carries an expanding member which moves outwardly when the piston is moved from the first portion through the transition portion to the second portion to contact the deformation ring and to force it against the edge of the braking sleeve so as to deform the braking sleeve starting from its edge which faces the piston radially inwardly to effect the braking of the piston. In one embodiment, the expanding member comprises a ring carried on the piston which rides in a groove of the piston and which is urged outwardly by gases which propel the piston and which communicate with the groove to a passage defined in the rear face of the piston. In another embodiment, the expanding member includes a ring carried on the opposite end of the piston from the end exposed to the propelling gases with a sleeve having a plurality of longitudinal slits which permit the sleeve to be deflected downwardly by the first portion of the tube in which the piston is movable, but which may move outwardly when the piston moves through the transition zone to the second portion so as to contact a deformation ring which is urged by the expanding member to deform the braking sleeve.

6 Claims, 4 Drawing Figures

APPARATUS FOR BRAKING A FREE PISTON, WHICH IS DRIVEN AT HIGH ACCELERATION WITHIN A TUBE

FIELD AND BACKGROUND OF THE INVENTION

This invention relates in general to firearms and, in particular, to a new and useful apparatus for braking a free piston driven at a high acceleration within a tube, by plastic deformation of material, comprising a deformable braking sleeve which is fixed to the tube wall in the zone of that tube end toward which the piston is accelerated, in particular, a braking sleeve, having its end facing the piston beveled toward the inside to a knife-shaped edge and deforming, upon the impingement of the piston and starting from this edge, radially inwardly.

DESCRIPTION OF THE PRIOR ART

In the prior art arrangements of this kind, it is usual to associate the free piston filling the tube caliber, with a braking sleeve projecting into the caliber proper of the tube. The problem with this design is that during expulsion, it is difficult to pass the charge to be expelled by means of the free piston through such a reduced caliber braking sleeve without troubles occurring, primarily, if the charge to be expelled comprises several parts, as in the case of the inert masses which are frequently used for recoil compensation in recoilless tube weapons. To overcome this problem, up to the present time, appropriately reduced calibers of the charge to be expelled and lateral supports thereof on the inside surface of the tube wall in the form of strips or similar elements have been provided which, incidentally, require greater tube lengths. In addition, the possibility of impeding the function of the braking sleeve by the lateral supporting elements of the expulsion charge is not eliminated.

SUMMARY OF THE INVENTION

In accordance with the invention, an expanding member is provided on the circumference of the free piston, which applies with bias against the inside surface of the tube wall. The tube is designed with a cylindrical excess-caliber portion extending in the zone of the braking sleeve and includes an enlarging transition zone, the diameter of which, starting from the tube caliber, increases to the excess caliber, and the caliber of the braking sleeve is made equal to or larger than that of the tube.

The inventive measures require small costs of material and time and there is no need for larger outside tube diameters as in the case of the known piston catching mechanisms with a reduced caliber braking sleeve. In all instances of application, any charge to be expelled, with lateral supporting elements omitted, as well as the free piston associated therewith for expulsion, may occupy the entire tube caliber, and this permits shorter overall lengths of the tube. With the omission of the lateral supporting elements, the impairment due thereto of the baking sleeve function is also absent. This omission of elements laterally supporting the charges to be expelled is made possible by the special arrangement and dimensioning of the braking sleeve, in connection with the provided association with the free piston and the expanding member, whereby, any problem of passing the charge through is eliminated.

During the motion of the piston along the transition zone, the diameter of which, for example, enlarges conically from the tube caliber proper to the excess caliber portion of the tube extending in the zone of the braking sleeve, the expanding member executes a radially outwardly directed spreading motion. Spread out in this manner, the expanding member comes into engagement with the braking sleeve. The inside diameter of the sleeve is equal to or even larger than the caliber proper of the tube, in order to avoid problems with the passing through of the charge to be expelled. By the deformation of the braking sleeve subsequently produced, the kinetic energy of the moving assembly free piston/expanding member is absorbed and, consequently, the motion thereof is stopped.

The following features of the invention make it possible to relieve the load on the expanding member. In the excess caliber portion of the tube, between the enlarging transition zone thereof and the braking sleeve and in a spaced position from the inwardly beveled knife edge of the sleeve, a deformation ring is provided, made preferably of a hard material, such as steel, which has an inside diameter corresponding at least to the tube caliber proper and is axially shiftable. This deformation ring which, during a motion of the free piston in the direction of the braking sleeve is taken along by the expanding member of the piston after this member has radially expanded. The deformation ring is provided with a knife edge mating with that of the braking sleeve on its front side remote from the expanding member and is thus beveled outwardly. The cooperation of this knife edge with that of the braking sleeve ensures that, upon impact, the sleeve is deformed in the radially inward direction.

For reasons of simplicity of construction, it is advisable to employ a piston ring which is prestressed for radial expansion and received in a circular groove on the circumference of the free piston as an expanding member. According to a development of the invention, this circular groove for receiving the radially prestressed piston ring communicates through one or more passages provided in the piston, at the inside of the piston ring, with the space behind the rear face of the piston, considered in the direction of acceleration thereof. These passages serve the purpose of permitting compressed gases to pass therethrough, and exert a pressure on the piston ring in the radially outward direction, thus supporting the expansion of the piston ring caused by the initial stress, or even to produce a pressure which alone is capable of causing the piston ring to expand. In the last-mentioned instance, only a relatively low radial initial stress of the piston ring is needed, ensuring that, up to the expansion caused by the gas forces, the piston ring applies to the inside surface of the tube.

Another suitable and inexpensive design of the expanding member may also comprise a resilient ring which is longitudinally slit on its side facing the braking sleeve and is fixed to a reduced diameter portion of the free piston.

Accordingly, it is an object of the invention to provide an apparatus for braking a free piston which is driven at a high acceleration within a tube, particularly in recoilless firearms, comprising a tube which has a first portion of a first diameter, a second portion of a second diameter greater than the first portion, and a transition portion between the first and second portions increasing in diameter from the first portion to the second portion and which includes a free piston freely movable in the first portion which has substantially the same diameter as the first portion, and an expanding member means which includes a member carried by the piston being confined by the first portion of the tube to substantially the diameter of the piston, but being expandable in the tube outwardly when moved with the piston through the transition portion to the second portion which acts either directly or through a deformation ring which forms part of the expanding member means to engage and form a deformable braking sleeve which is fixed to the interior of the tube at the second portion thereof so that it moves radially inwardly starting from the edge adjacent the piston.

A further object of the invention is to provide an apparatus for braking a free piston which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which preferred embodiments of the invention are illustrated.

DESCRIPTION OF THE PREFERRED EMBODIMENTS

Figure 1A:
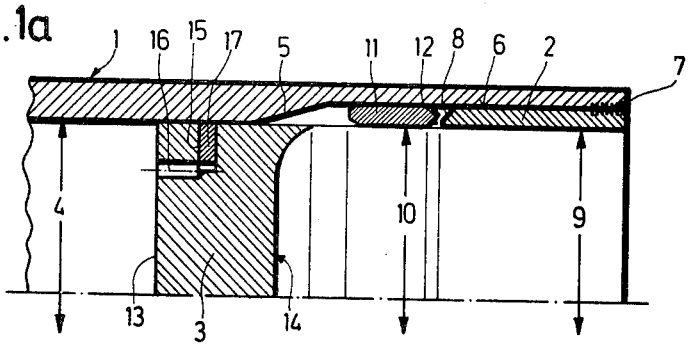
FIG. 1*a* is a partial axial sectional view of the cylindrical end portion of a tube with a braking sleeve and a free piston in a position prior to braking the piston, constructed in accordance with the invention.
Figure 1B:
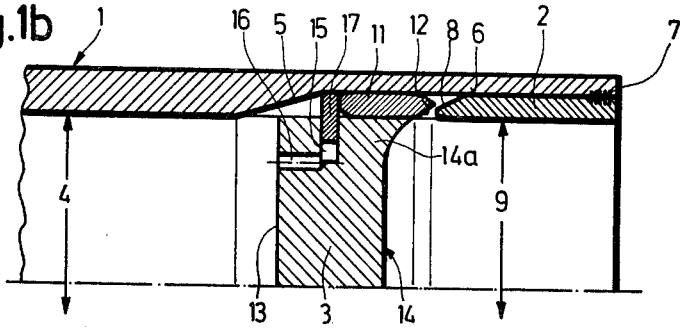
FIG. 1*b* is a view similar to FIG. 1*a* showing the initial stage of the braking process.
Figure 1C:
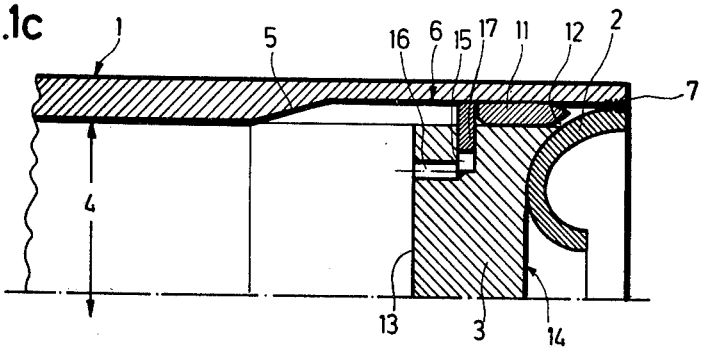
FIG. 1*c* is a view similar to FIG. 1*a* showing the free piston at the end of the braking process.

Referring to the drawing in particular, the invention embodied therein comprises, an apparatus for braking a free piston which is driven at a high acceleration within a tube, such as a cylindrical tube 1, of a recoilless firearm. FIGS. 1*a*, 1*b* and 1*c* show a cylindrical tube 1, a braking sleeve 2, and a free piston 3. Tube 1 comprises a cylindrical excess caliber or wider diameter second portion 6 and a transition zone 5 gradually enlarging, for example, conically, from a principal tube caliber or first portion 4. The deformable braking sleeve 2 is received in the excess-caliber portion 6 of the tube and is secured to the inside of the tube wall at 7, for example, by welding or with screws. Sleeve 2 is provided on its side facing free piston 3 with an inwardly beveled knife-shaped edge 8. Caliber 9 of the sleeve and caliber 4 of the tube are, for example, equal to each other. The same applies to the caliber 10 (FIG. 1*a*) of a deformation ring 11 of steel or a similar hard material, which forms a cooperative element of expanding means associated with the free piston 3. Deformation ring 11 is received for axial displacement in excess caliber portion 6 of the tube, between the conically enlarging transition zone 5 and braking sleeve 2. Deformation ring 11 is provided with a mating, outwardly beveled knife edge 12 on its side facing knife edge 8 of the braking sleeve, which is beveled inwardly.

As may be learned from FIG. 1*a*, free piston 3 fills the tube caliber proper completely. Piston 3 can be accelerated in the direction of braking sleeve 2 by the gas pressure acting against its rear face 13. Free piston 3 is provided with an inwardly curved edge 14*a* on its front face 14 turned to braking sleeve 2 which, as shown in FIG. 1*c*, cooperates with knife edge 12 of the deformation ring 11 to produce a radially inward deformation of braking sleeve 2, by which strain work, the kinetic energy of the piston is absorbed.

A circular groove 15 is provided on the circumference of free piston 3. A plurality of passages 16 extend from the bottom of the groove 15 to the rear face 13 of the piston. The expanding means also includes an expanding member in the form of a piston ring 17 which is positioned in the groove 15 and has an initial stress acting outwardly.

In the piston position shown in FIG. 1*a*, piston ring 17 is kept within tube caliber 4 by contact with the inside surface of the wall of the tube 1. Piston ring 17 is retained within this initial diameter until it reaches transition zone 5. While moving past this transition zone 5, along with free piston 3, piston ring 17 gradually expands, under the action of, or with the support of, the gas pressure present in circular groove 15, until it finally attains its expanded position as shown in FIG. 1*b*. Thus expanded, piston ring 17 impinges on deformation ring 11, as shown in FIG. 1*b*, and takes the ring along. Thereafter, during further motion, knife edge 12 of deformation ring 11, thus taken along, penetrates into the wedge-shaped annular space bounded by knife edge 8 of braking sleeve 2 and the inside wall surface of excess caliber portion 6 of tube 1. This penetration of deformation ring 11 results in an energy-absorbing plastic deformation of braking sleeve 2, as shown in FIG. 1*c*, by which piston 3 is stopped.

Figure 2:
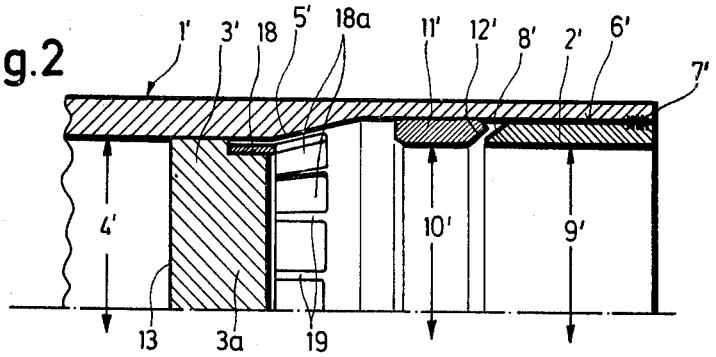
FIG. 2 is a view similar to FIG. 1*a* showing another embodiment of the expanding member, with the free piston and the braking sleeve in positions immediately prior to the start of the braking process.

The embodiment shown in FIG. 2 differs from that of FIGS. 1*a*, 1*b* and 1*c* only in the provision of an expanding member 18 in place of the piston ring 17. Here, the expanding member 18 is designed as a resilient ring which is provided with longitudinal slits 19 on its side facing braking sleeve 2', and is fitted to a portion 3*a* of free piston 3' which has a reduced outside diameter. Ring 18 in FIG. 2 is shown after its longitudinally slit portion 18*a* has expanded in the conically enlarged transition zone 5' to the excess caliber portion 6' of cylindrical tube 1'.

While specific embodiments of the invention have been shown and described in detail to illustrate the application of the principles of the invention, it will be understood that the invention may be embodied otherwise without departing from such principles.

What is claimed is:

1. An apparatus for braking a free piston which is driven at a high acceleration within a tube, particularly in a recoilless firearm, comprising a tube having a first portion of a first diameter, a second portion of a second diameter greater than the said first portion diameter and a transition portion between said first and second portions increasing in diameter from the first portion to the second portion, a free piston having substantially the same diameter as said first portion freely movable in said first portion, expanding member means including an expanding member carried by said piston and being confined by said first portion of said tube to substantially the diameter of said piston but being expandable in said tube outwardly when moved with said piston through said transition portion and to said second portion, a deformable braking sleeve fixed to the interior of said second portion of said tube and having an inwardly bevelled edge facing toward said piston and having an interior diameter at least equal to said first portion of said tube, a sleeve deformation ring in said second portion of said tube between said piston and said braking sleeve, said expanding member being movable outwardly with movement of said piston from said first portion to said second portion through a path intercepting said ring to move said ring against said braking sleeve and being effective during such movement to deform said braking sleeve starting from its edge facing said piston radially inwardly to brake said piston.

2. An apparatus according to claim 1, wherein said member carried by said piston comprises a resilient ring having a portion which is longitudinally slit on the end thereof adjacent said braking sleeve and which is expandable outwardly in said transition zone and said second portion of said tube so as to engage said deformation ring when said piston is moved into said second portion.

3. An apparatus according to claim 1, wherein said piston includes an edge facing said braking sleeve which has an inwardly curved portion, and including said deformation ring having an interior diameter at least equal to the first portion diameter, said deformation ring having an edge adjacent the edge of said braking sleeve forming a complementary curve with the edge of said piston, said expanding means including a ring carried by said piston engageable with said deformation ring to cause deformation said ring to engage with the edge of said braking sleeve and deform it so as to engage the edge of said piston.

4. An apparatus according to claim 1, wherein said deformation ring is of a hard material having an interior diameter of at least the diameter of said first portion and being disposed between said edge of said braking sleeve and said piston and being axially displaceable, said deformation ring having an edge adjacent said braking sleeve bevelled edge tapering outwardly in a direction toward said braking sleeve forming a counteredge engageable with said bevelled edge, said deformation ring being deflected by said member to deform said braking sleeve.

5. An apparatus according to claim 4, wherein said member comprises a ring, said piston having an annular groove therearound in which said ring extends, said ring having a radially outwardly directed bias.

6. An apparatus according to claim 5, including passage means in said piston for communicating the interior of said ring in said groove with a space in said first portion of said tube on the other side of said piston from said braking sleeve.

* * * * *